US005216973A

United States Patent [19]

Gwinn

[11] Patent Number: 5,216,973

[45] Date of Patent: Jun. 8, 1993

[54] OIL SPILL PROTECTOR

[76] Inventor: Charles M. Gwinn, 4513 S. Meadows, Alvin, Tex. 77511

[21] Appl. No.: 881,168

[22] Filed: May 11, 1992

[51] Int. Cl.[5] ..... B63B 43/16

[52] U.S. Cl. ..... 114/229; 114/74 R

[58] Field of Search ..... 114/227, 228, 229, 74 R, 114/222, 270

[56] References Cited

U.S. PATENT DOCUMENTS

| | | | |
|---|---|---|---|
| 1,099,167 | 6/1914 | Czerniawski | 114/229 |
| 1,395,813 | 11/1921 | Geroianne | 114/229 |
| 3,183,876 | 5/1965 | Kronhaus | 114/229 |
| 5,003,908 | 4/1991 | Wilson | 114/229 |

*Primary Examiner*—Jesus D. Sotelo

[57] ABSTRACT

An apparatus for protecting the environment from liquid spills, such as oil, when ocean going vessels become damaged and leak, having a flexible, durable and waterproof material deployed around the vessel to form a double hull type apparatus. Thus, having all vessels, which carry cargo dangerous to the environment, equipped with an apparatus that would automatically surround it if it sprang a leak would help to protect the environment. An apparatus, whereby when not in use is stored inside a protective housing, and when needed, would be powered by power units to pull the protective sheeting around the vessel, sealing the bow and the stern of the vessel, but allowing the propulsion system of the vessel to continue to operate, powering the vessel.

1 Claim, 3 Drawing Sheets

OIL SPILL PROTECTOR

PRIOR ART

Pat. Nos.: 5,003,908, 3,183,876, 1,395,813, 1,099,167

OBJECTS

This invention is easy to construct because of its simplicity and the materials are readily available. Further, the cost of manufacturing this device would be economical because there is no special equipment necessary for its manufacture. All equipment and tools are standard and available. This apparatus is easily stowed away in its special container which will keep it out of the weather. It is also easily deployed when necessary to protect the environment from an oil spill. If the majority of the vessels which carry oil or other products hazardous to the environment employed this apparatus there would be very little damage to the environment due to the spills. Once this apparatus has been deployed, around a vessel which is leaking, the leakage will be stopped. When this apparatus is deployed, the vessel will still be able to navigate in the usual manner and thereby deliver its cargo safely and intact.

Further objects and advantages of my invention will become apparent from a consideration fo the drawings and ensuing description thereof.

DISCUSSION OF PRIOR ART

Heretofore, large vessels carrying oil across open waters, on occasions will leak. This is due sometimes to mechanical failure of the vessel's hull. In most cases, sufficient oil leaks into the water and causes severe damage to the environment. This damage is sometimes permanent such that some parts of the environment will never recover. At the present time a leaking vessel has to continue to leak until some means of removing the remaining oil from the vessel arrives. Until this happens, the vessel will continue leaking oil into the environment.

DRAWINGS

DESCRIPTION

Figure 1:
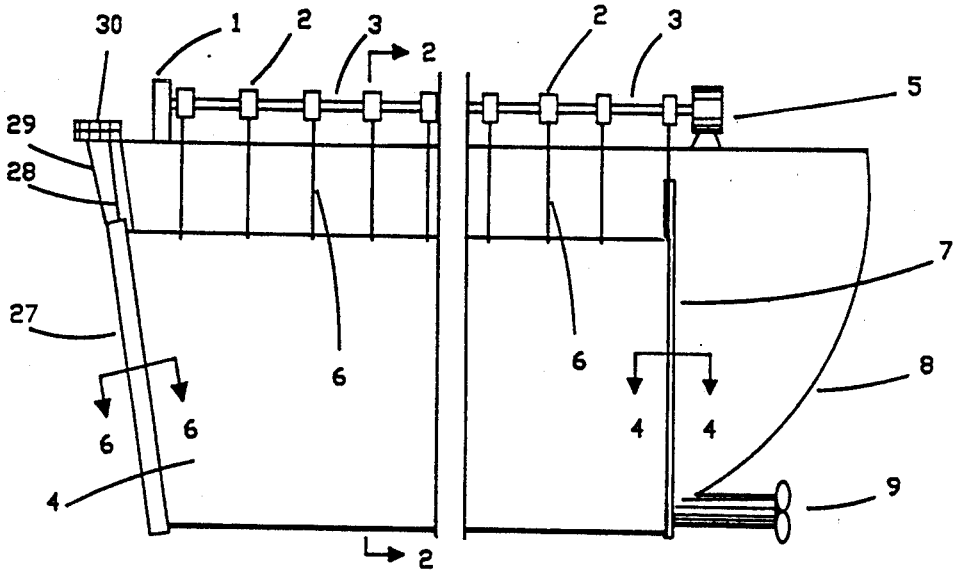
FIG. 1 illustrates a side view of this invention, fully deployed on a vessel.

FIG. 1 would illustrate the preferred embodiment of the apparatus of this invention wherein vessel 8 has attached to it bearing unit 1 and drive unit 5 which supports wind-up shaft 3. Wind-up shaft 3 has wind-up reels 2 attached to it so as to be able to rotate on wind-up shaft 3. Protective sheeting 4 is shown fully deployed around vessel 8, and is supported by cables 6, and cables 6 are wound up on wind-up reel 2. At the rear of vessel 8 is shown the edge of the protective sheeting 4 where it is sealed to stern sealing device 7.

The rear of vessel 8 also illustrates the navigational ability of vessel 8 by vessel screw 9.

At the bow of vessel 8 the protective sheeting 4 is sealed by bow seal 27, and tether 29 is attached to the top end of bow seal 27. The other end of tether 29 is attached to the bow platform 30. Bow cables 28 are attached to the front and top of protective sheeting 4. The other end of bow cables 28 are attached to the bow platform 30. Bow platform 30 is securely attached to the bow of vessel 8.

Figure 2:
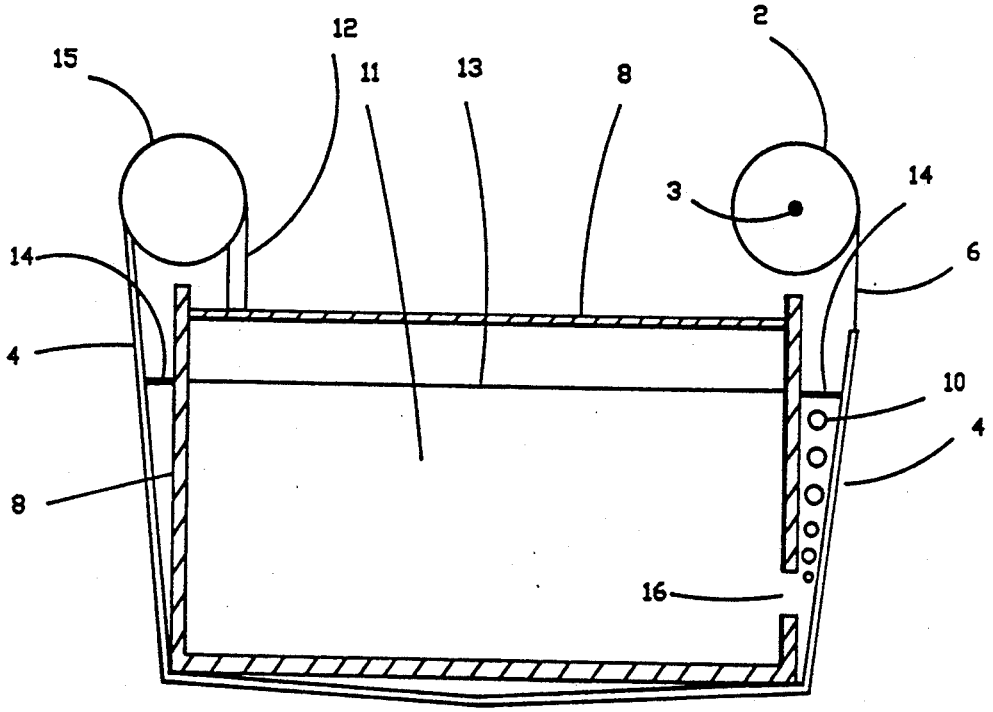
FIG. 2 illustrates a sectional view, A—A as shown in FIG. 1.

FIG. 2 would illustrate a sectional view, section A—A, of the preferred embodiment in FIG. 1 wherein vessel 8 has attached to it take-up reel 2 with wind-up shaft 3 to support it. Take-up reel 2 has cable 6 wound up on it, and cable 6 supports protective sheeting 4. Protective sheeting 4 is surrounding the bottom and sides of vessel 8. Feed-out reel 15, which is attached to the deck of vessel 8 by support 12, holds the protective sheeting 4 and lets it out as the take-up reel 2 requires it. Vessel 8 has a liquid level 13 of liquid 11 contained in its inside portion and has a breach 16 at its lower right side from which liquid leaks shown by bubbles 10. The leak through breach 16 produces liquid level 14 between the side walls of vessel 8 and protective sheeting 4 on both sides of vessel 8.

Figure 3:
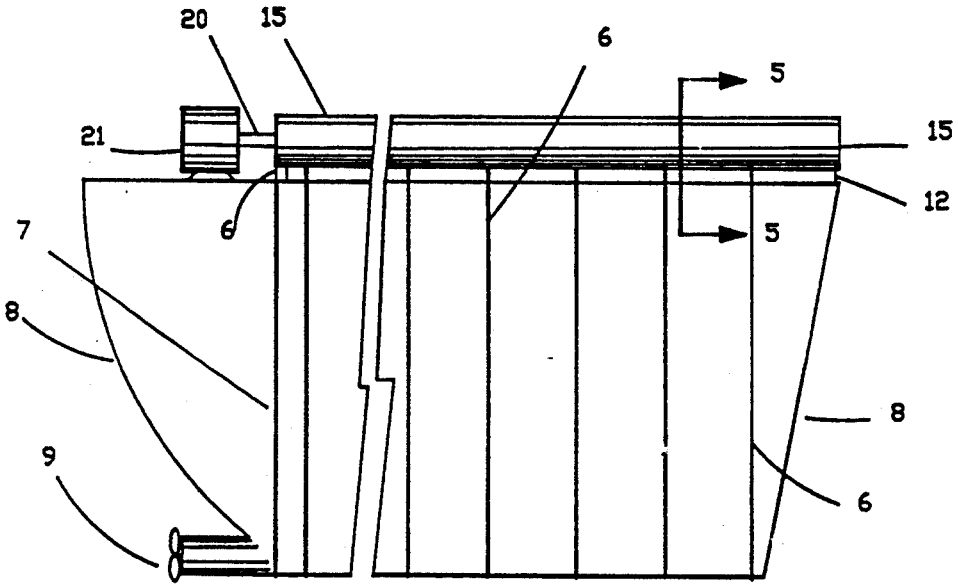
FIG. 3 illustrates a side view of this invention showing the other side of the vessel in FIG. 1.

FIG. 3 would illustrate a side view of the opposite side of vessel 8, shown in FIG. 1, wherein feed-out reel 15, which houses the protective sheeting not shown in this figure, spans nearly the full length vessel 8. Feed-out reel 15 is supported by support 12 from the deck of vessel 8. Drive motor 21 ia attached to the deck of vessel 8 and turns shaft 20 which runs the full length of feed out reel 15. Attached to shaft 20 is protective sheeting (not shown in this figure). Cables 6 which are attached to protective sheeting, at various point along its length, extends from the feed-out reel 15 under vessel 8 and up the other side of vessel 8 to the take-up reel(not shown in this figure). Stern sealing device 7 is attached to the side of vessel 8 and extends down to the bottom, underneath, and up the other side of vessel 8. Screw 9 is the propulsion device for vessel 8. Bow platform 30 is attached to the bow of vessel 8 and extends forward beyond vessel 8.

Figure 4:
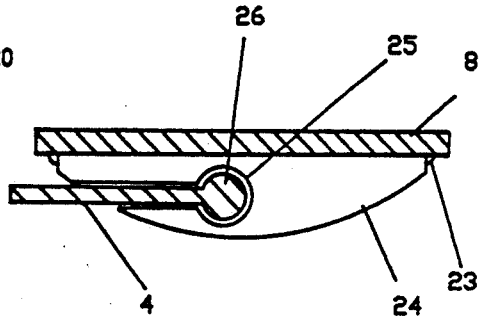
FIG. 4 illustrates a sectional view, B—B of the stern sealing device.

FIG. 4 would illustrate a sectional view (section B—B) of stern sealing device 7 for sealing the protective sheeting 4 to the vessel 8. Stern sealing device 7 is secured to the side wall and completely around vessel 8 from side to side. Stern sealing device 7 has a slot 25 cut in it, its full length. The edge of protective sheeting 4, nearest the stern, has a rear attachment 26 which has a circular cross-sectional area, attached to the full length of the protective sheeting 4, and is smaller in diameter than slot 25 in stern sealing device 7. A cable (not shown) is attached to the leading edge of protective sheeting 4, at the point of the rear attachment 26. The cable is threaded through slot 25 for its full length. The other end of the cable is attached to the wind-up reel (not shown).

Figure 5:
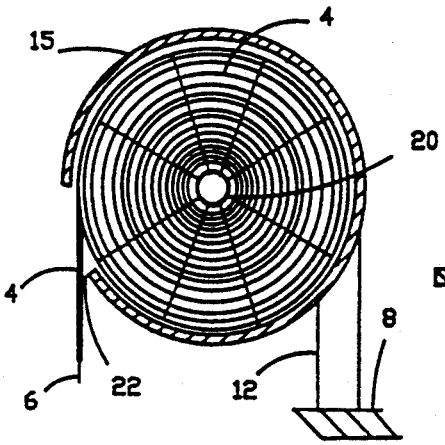
FIG. 5 illustrates a sectional view, C—C of the feed-out reel.

FIG. 5 would illustrate a sectional view (section C—C) of the feed-out reel. Inside the feed-out reel is the protective sheeting 4 wound up on shaft 20. The leading edge of the protective sheeting 4 exits opening 22, and cable 6 is attached to it.

Figure 6:
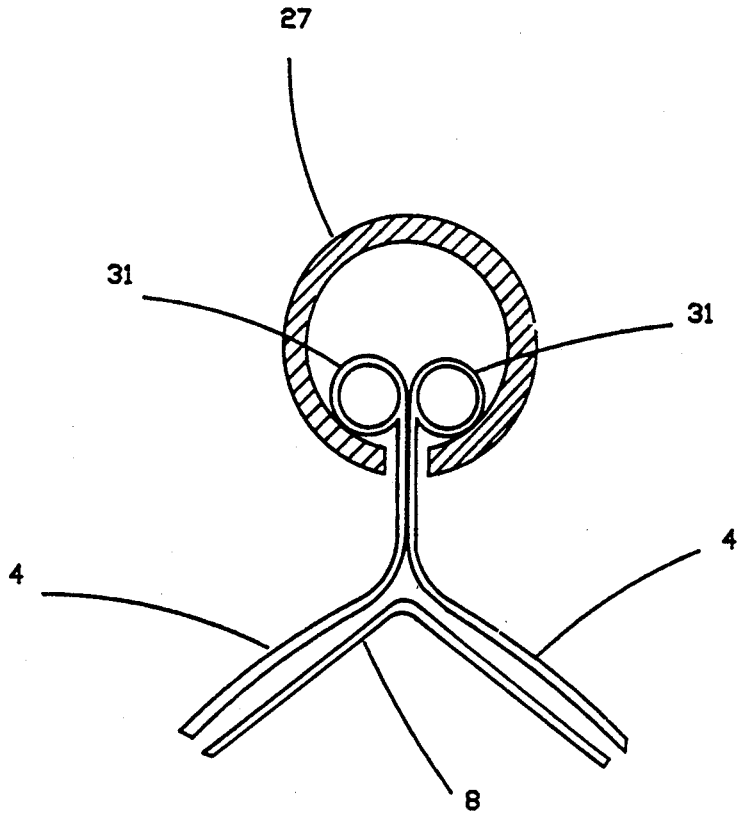
FIG. 6 illustrates a sectional view, D—D of the bow sealing device.

FIG. 6 illustrates section D—D wherein the bow of vessel 8 is protected by protective sheeting 4. The front edge of protective sheeting 4 has an attachment 31 for its full length. Bow seal 27 seals the bow portion protective sheeting 4 from top to bottom.

OPERATION

FIG. 1 illustrates the preferred embodiment of the apparatus and method of the present invention where is illustrated a side view of vessel 8, wherein vessel 8 is mostly constructed of metal and is hollow inside and is for the purpose of carrying cargo such as liquids. Vessel 8 floats in water and is propelled by the turning of screw 9 by an engine (not illustrated). The protective sheeting 4 consist of a flexible waterproof material such as a reinforced polypropylene or the like which fits around vessel 8 from the bow to the stern (not including the screw) of vessel 8. The protective sheeting 4 is sealed to the vessel 8 from side to side by the stern sealing device 7. Stern sealing device 7 is constructed of a rigid durable material such as metal, or equal, and is for the purpose of sealing the protective sheeting 4 to vessel 8. Protective sheeting 4 is supported by cables 6. Cables 6 is made of durable, strong material, such as steel or equal. One end of each cable 6 is attached to the edge of the protective sheeting 4 at several points along this edge, one cable per point. The other end of each cable 6 is attached to, and wound up on wind-up reel 2. Wind-up shaft 3 supports all the wind-up reels 2 (each wind-up reel 2 is rigidly fastened to the wind-up shaft 3), and each wind-up reel 2 is at the proper position on the wind-up shaft 3 to handle each cable 6 properly. Wind-up shaft 3 consist of a round bar of rigid material, such as steel, and it extends the distance from drive unit 5 to the bearing unit 1. The drive unit 5, consisting of a device which can be powered by electricity or an equivalent source of power, and is anchored to the top deck of vessel 8. Drive unit 5 is attached to wind-up shaft 3, and when the drive unit 5 turns the wind-up shaft 3 in the proper direction, the wind-up reels 2 will also turn, thereby winding up cables 6 on them. The protective sheeting 4 will be pulled from one side of vessel 8 to the other side by the cables 6 as they are wound up on wind-up reel 2 as a result of the turning of wind-up shaft 3 by drive unit 5. The bearing unit 1 supports the other end of wind-up shaft 3 and it is anchored to the deck of vessel 8. The purpose of bearing unit 1 is to permit the smooth rotation of wind-up shaft 3.

Bow platform 30 is an attachment to the bow of vessel 8 to allow for two or more people to stand. The bow platform has a surface to stand on, constructed of metal, with a railing around it. Bow cables 28, which are attached to each end of protective sheeting 4, are tied off to the bow platform 30 to help support the front edge of the protective sheeting 4. Bow seal 27 is a pipe constructed of plastic or light weight metal, its purpose is to seal the bow portion of the protective sheeting 4. Bow seal 27 is a pipe which has a narrow slit in it from top to bottom. Both halves of the front edge of protective sheeting 4 are brought together by sliding them up into the slit of bow seal 27. Bow seal 27 is handled from bow platform 30, where it is pushed down over the front edge of protective sheeting 4. Bow cables 28 hold protective sheeting 4 in place to allow bow seal 27 to be put in place after bow seal 27 has been put in place it is supported by tether 29. One end of tether 29 is attached to bow seal 27 and the other end is secured to bow platform 30.

FIG. 2 illustrates a sectional view, section A—A, of vessel 8, wherein is seen vessel 8 consisting of top deck, side walls, and a bottom. Vessel 8 has a cargo area wherein liquid 11 is being carried. The lower right wall of vessel 8 illustrates how a breach 16 in the hull of vessel 8 would cause its liquid contents to leak out, as can be seen, the protective sheeting 4 prevents liquid 11 from leaking into the surrounding waters. The protective sheeting 4 surrounds three sides of vessel 8, both sides and the bottom.

Feed-out reel 15 consists of a long cylindrical container where the protective sheeting 4 is coiled inside, see section C—C. Feed-out reel 15 is attached to and supported by support 12. Support 12 consist of a rigid material strong enough to support feed-out reel 15 and capable of being securely attached to the deck of vessel 8.

Wind-up reel 2 consist of a reel, made of rigid material, such as steel, and has wind-up shaft 3 through its center, and is firmly attached to wind-up shaft 3 so that both will rotate together. When the wind-up reel 2 rotates, cable 6 which is attached to the edge of protective sheeting 4, is wound up on it thereby pulling the protective sheeting 4 around vessel 8. Further illustrated in the liquid level 13 of the liquid inside vessel 8, and the level of the leaking liquid 14 which is between the protective sheeting 4 and the inside walls of vessel 8. Bubbles 10 illustrates the leaking of liquid 11 through breach 16. When the liquid level 14 reaches the same level as the vessel 8 liquid level 13 then the liquid 11 will stop leaking through breach 16.

FIG. 3 would illustrate a side view of the apparatus and method of this invention wherein vessel 8 is illustrating the feed-out reel 15 which is nearly the length of vessel 8. The feed-out reel 15 has a drive shaft 20 which is made of a rigid material, and it runs the full length of the feed-out reel 15. The purpose of the drive shaft 20 is to be turned in either direction, to feed out the protective sheeting inside the feed-out reel 15, or to rewind the protective sheeting back into its feed-out reel 15 after use. Drive motor 21, which is anchored to the deck of vessel 8, is for the purpose of turning drive shaft 20. Since the protective sheeting is connected to drive shaft 20, when the drive motor 21 turns drive shaft 20 in either direction, the protective sheeting will wind up or wind down as required. Drive motor 21 would be an electric motor or an air powered device. Cables 6 are constructed of rope like material consisting of metal or polypropylene. Each cable 6 is attached to the leading edge of the protective sheeting (not shown) at spaced intervals to help support the protective sheeting. Each cable 6 runs under vessel 8 and is attached to separate reels on wind-up reel, not shown, on the other side of vessel 8. Support 12, which supports the feed-out reel 15, is attached securely to the deck of vessel 8. Stern sealing device 7 is shown near the stern of vessel 8. The purpose of the stern sealing device 7 is to seal the protective sheeting to itself to prevent the leakage of liquid through it. When the protective sheeting is being deployed the back edge of the protective sheeting is pulled, by a cable, through the stern sealing device 7. Sealing the protective sheeting at this point will not interfere with the propulsion unit, Screw 9.

Bow platform 30 is attached to the bow of vessel 8 and it protrudes forward beyond vessel 8. When the protective sheeting is deployed bow platform 30 is used to work from, to insert the bow seal device over the front edge of the protective sheeting.

FIG. 4 would illustrate a sectional view, section B—B of the stern sealing device, wherein is shown a portion of the hull of vessel 8, near the stern. Stern sealing device is attached securely with weld 23 to the hull of vessel 8, completely around, from side to side.

Stern sealing device has a slot 25 cut in it, for its full length. Slot 25 has a cross-section which is shaped similar to a "keyhole", with a narrow portion, and a broad circular portion.

Rear attachment 26 is attached to the stern edge of protective sheeting 4, for its entire length, wherein rear attachment 26 has a circular cross-sectional area, and its diameter is greater than the width of the smallest part of the slot in the stern sealing device, but smaller than the largest part of the slot in the stern sealing device. Rear attachment 26 is of tubular construction made of a rubber, or plastic, elastic and flexible material, and is attached to protective sheeting 4 with an adhesive or a vulcanization process.

When the protective sheeting 4 is being deployed, a cable attached to the beginning of rear attachment 26 is pulled through the slot in the stern sealing device, thereby pulling the rear attachment 26, which is attached to protective sheeting 4, up through the slot in the stern sealing device.

FIG. 5 would illustrate a sectional view, section C—C, of the feed-out reel 15 wherein is shown the protective sheeting 4 coiled up inside the feed-out reel 15. The protective sheeting 4 is attached, at its beginning edge, to the drive shaft 20, drive shaft 20 extends the full length of the feed-out reel 15. The leading edge of protective sheeting 4 feeds out through opening 22. Opening 22 extends the full length of feed-out reel 15. Feed-out reel 15 is similar to a long pipe with a slit-like opening, opening 22, to allow the protective sheeting 4 to move in and out. The action of the protective sheeting 4 is like that of a window shade, the way it winds up and down on a shaft. Cable 6 is shown attached to the leading edge of protective sheeting 4. Support 12 is for the purpose of supporting the feed-out reel 15, for its entire length. Support 12 is anchored to the deck of vessel 8.

FIG. 6 would illustrate section D—D and how the bow of vessel 8 is sealed by the bow seal 27. When the protective sheeting 4 is deployed there will be an excess protruding beyond the bow of vessel 8.

Front attachment 31 is shown attached to the front edge of protective sheeting 4, wherein front attachment 31 has a circular cross-sectional area, and its diameter is greater than the width of the slot in the bow seal 27. The inside diameter of bow seal 27 is large enough to allow both halves of the edge of protective sheeting 4, with front attachment 31, to fit inside. With front attachment 31 attached to the edge of protective sheeting 4, the protective sheeting 4 can not slip through the slot in bow seal 27. Oil trapped between vessel 8 and protective sheeting 4 would have to escape through bow seal 27 in order to reach the surrounding waters. Bow seal 27 would be sized properly to ensure a sufficient seal.

Front attachment 31 is constructed of tubular material, consisting of a plastic or rubber like material, wherein the material is elastic and flexible. Front attachment 31 is attached to the full length of the leading edge of the protective sheeting 4 via an adhesive or a vulcanizing means. Attachment 31 has a diameter which is greater than the thickness of the protective sheeting 4.

BROADENING PARAGRAPHS

While the above description contains many specificities, these should not be construed as limitations of one preferred example, the same protection could be provided to a vessel if all the surfaces exposed to water were encased in a protective sheeting instead of using sealing devices. Accordingly, the scope of the invention should be determined not by the embodiment illustrated, but by the appending claims and their legal equivalents.

What is claimed as invention is:

1. An apparatus for limiting and containing liquid spills from leaking vessels that navigate the water ways, comprising:

a. a protective sheeting that is thin, flexible and waterproof which covers the vessel from side to side and underneath the vessel, and spans from the bow to the stern of the vessel, for keeping the leaking contents of the vessel from leaking into the surrounding waters;

b. a means for storing the protective sheeting when the protective sheeting is no longer needed, whereby the means for storing is attached to one side of the vessel and spans the full width of the protective sheeting from the bow to the stern of the vessel, and the means for storing is powered;

c. cables attached to the edge of the protective sheeting, at different points, for the purpose of enabling the protective sheeting to be deployed, and to assist in the support of the protective sheeting when the protective sheeting is deployed;

d. a means for pulling the protective sheeting from storage, for deployment from one side of the vessel to the other side of the vessel, whereby the means for pulling the protective sheeting is attached to the vessel opposite the side where the protective sheeting is stored, wherein all the cables are connected separately and individually to the means for pulling by their end opposite their connection to a leading edge of the protective sheeting, whereby the means for pulling the protective sheeting pulls all of the cables simultaneously, thereby pulling the protective sheeting from one side of the vessel to the other side of the vessel, and the means for pulling the protective sheeting is powered;

e. a stern sealing unit for sealing the protective sheeting to the stern of the vessel completely around the hull of the vessel for the prevention of the leakage of unwanted liquid into surrounding waters, whereby the stern sealing unit is attached to the hull of the vessel, near the stern and just before the propulsion screw of the vessel, and spanning down the hull and underneath the hull and up the other side of the hull of the vessel, whereby upon deployment of the protective sheeting one of the cables is used to guide the end of the protective sheeting, to be sealed, into the stern sealing unit; and f. a bow sealing unit for sealing the protective sheeting which covers the bow of the vessel, whereby the bow sealing unit fits over the front edge of the protective sheeting from the top to the bottom, thereby preventing the leakage of unwanted liquid into the surrounding waters.

* * * * *